US011920315B2

(12) United States Patent
Wang et al.

(10) Patent No.: US 11,920,315 B2
(45) Date of Patent: Mar. 5, 2024

(54) WIRELESS DETECTION DEVICE AND WIRELESS DETECTION METHOD FOR QUICKLY POSITIONING THROW-FILL STONE FALLING DEPTH AND LONG-TERM SETTLEMENT IN BLASTING SILT-SQUEEZING CONSTRUCTION

(71) Applicant: WENZHOU UNIVERSITY, Wenzhou (CN)

(72) Inventors: Jun Wang, Wenzhou (CN); Wei Qin, Wenzhou (CN); Liujun Zhang, Wenzhou (CN); Junfeng Ni, Wenzhou (CN); Ziyang Gao, Wenzhou (CN); Yonggang Hu, Wenzhou (CN); Chaohao Pan, Wenzhou (CN); Jinrong Zhang, Wenzhou (CN); Xudong Dong, Wenzhou (CN)

(73) Assignee: WENZHOU UNIVERSITY, Wenzhou (CN)

( * ) Notice: Subject to any disclaimer, the term of this patent is extended or adjusted under 35 U.S.C. 154(b) by 165 days.

(21) Appl. No.: 17/510,406

(22) Filed: Oct. 26, 2021

(65) Prior Publication Data

US 2023/0044394 A1 Feb. 9, 2023

(51) Int. Cl.
*E02D 1/02* (2006.01)
*E02D 33/00* (2006.01)

(52) U.S. Cl.
CPC ..... *E02D 1/022* (2013.01); *E02D 33/00* (2013.01)

(58) Field of Classification Search
CPC ..... E02D 33/00
See application file for complete search history.

(56) References Cited

U.S. PATENT DOCUMENTS 5,685,256 A * 11/1997 Green ..... G01L 19/12 116/214
2017/0268874 A1* 9/2017 Kasahara ..... G01C 9/02

FOREIGN PATENT DOCUMENTS

CN 208125305 U * 11/2018 ..... G01L 1/22
CN 108955979 A * 12/2018
CN 111307355 A * 6/2020 ..... G01L 1/247
CN 111854931 A * 10/2020
CN 112049100 A * 12/2020 ..... E02D 1/00
CN 112177057 A * 1/2021
CN 112359809 A * 2/2021 ..... E02D 1/00

(Continued)

*Primary Examiner* — Herbert K Roberts

(57) ABSTRACT

Disclosed is a wireless detection device for quickly positioning a throw-fill stone falling depth and long-term settlement in blasting silt-squeezing construction, including a gravity ball and a signal receiving, processing and controlling system. The gravity ball is internally provided with test mechanisms, signal collecting and transmitting apparatuses and batteries. Also disclosed is a wireless detection method implemented using the above wireless detection device. The device and the method can detect the throw-fill stone falling depth and distribution situation in a blasting silt-squeezing construction process in real time, so that the effect evaluation and quality control of blasting silt-squeezing can be monitored in real time, the situation that the falling of throw-fill stones is incomplete can be acquired in time, monitoring data support can be provided for corresponding processing measures, and long-term settlement and other monitoring can be carried out.

2 Claims, 2 Drawing Sheets

(56) References Cited

FOREIGN PATENT DOCUMENTS

| | | | | | |
|---|---|---|---|---|---|
| EP | 2795237 | B1 | * | 2/2017 | ..... F16L 1/11 |
| KR | 200422104 | Y1 | * | 7/2006 | |
| KR | 101224077 | B1 | * | 1/2013 | |
| TW | 201443316 | A | * | 11/2014 | |

* cited by examiner

WIRELESS DETECTION DEVICE AND WIRELESS DETECTION METHOD FOR QUICKLY POSITIONING THROW-FILL STONE FALLING DEPTH AND LONG-TERM SETTLEMENT IN BLASTING SILT-SQUEEZING CONSTRUCTION

TECHNICAL FIELD

The disclosure relates to a wireless detection device for quickly positioning a throw-fill stone falling depth and long-term settlement in blasting silt-squeezing construction. The disclosure also relates to a wireless detection method implemented using the above wireless detection device for quickly positioning a throw-fill stone falling depth and long-term settlement in blasting silt-squeezing construction.

BACKGROUND

In the process of building a foundation in a silt area, a blasting silt-squeezing construction method is usually adopted, and the basic process is that explosives are embedded in a silt layer in advance, and stones are thrown and filled in a cavity formed after explosion. A "stone tongue" is formed by the stones in the throwing and filling process, and the "stone tongue" moves along the cavity under the action of dead weight, so as to realize replacement of the stones and the silt. The construction quality control of the method is mainly to determine that the stones which are thrown and filled achieve a design depth, which is called "falling". However, in practical engineering, the stones cannot fall completely due to various reasons. Therefore, it is necessary to detect a falling depth of the method. At present, the commonly used falling depth detection methods include a volume balance method, a drilling detection method, a ground penetrating radar method, a seismic imaging method, a Rayleigh wave method and the like. These methods have various problems in practical application. For example, the volume balance method is low in accuracy, and the distribution of stones in the falling process cannot be judged. The drilling detection method is high in cost and long in time, and the actual situation of falling cannot be comprehensively mastered due to the selection of drilling points. The ground penetrating radar method is high in instrument cost, inconvenient to use, and high in experience requirement. The seismic imaging method and the Rayleigh wave method also have problems in cost and accuracy. Because all the existing methods have various problems, it is generally impossible to adopt only a single method to carry out throw-fill stone falling detection in blasting silt-squeezing, and the error is large, which seriously affects the construction period and progress, and even affects the engineering quality.

SUMMARY

The technical problem to be solved by the disclosure is to provide a wireless detection device for quickly positioning a throw-fill stone falling depth and long-term settlement in blasting silt-squeezing construction. The wireless detection device can detect the throw-fill stone falling depth and distribution situation in a blasting silt-squeezing construction process in real time, so that the effect evaluation and quality control of blasting silt-squeezing can be monitored in real time, and the situation that the falling of the throw-fill stones is incomplete can be acquired in time. The technical problem to be solved by the disclosure is to also provide a wireless detection method implemented using the above wireless detection device.

To this end, the wireless detection device for quickly positioning a throw-fill stone falling depth and long-term settlement in blasting silt-squeezing construction provided by the disclosure includes a gravity ball and a signal receiving, processing and controlling system. The gravity ball includes a housing supported by corrosion-resistant steel, and the housing is internally provided with test mechanisms, signal collecting and transmitting apparatuses and batteries. The test mechanisms send signals obtained by testing outwards through the signal collecting and transmitting apparatuses. The signal receiving, processing and controlling system is configured to receive a wireless signal transmitted by the gravity ball, and the signal receiving and controlling system is capable of controlling a monitoring device in the gravity ball.

Preferably, an overall mass-to-volume ratio of the gravity ball is equal or similar to the density of a thrown stone.

Preferably, each test mechanism includes a vacuum negative pressure monitoring system, a pore pressure sensor and a gas pressure sensor.

The vacuum negative pressure monitoring system includes a vacuum negative pressure detection apparatus, a vacuum negative pressure chamber, a vacuum negative pressure gas discharging apparatus, a vacuum negative pressure gas hole and fluid channel, and a vacuum negative pressure gas discharging hole, the vacuum negative pressure detection system is configured to measure a hydrostatic pressure, and gas in the vacuum negative pressure chamber is discharged through the vacuum negative pressure gas discharging apparatus.

The pore pressure sensor is configured to measure a pore pressure in silt to determine a dissipation degree of an excess pore pressure in a blasting operation.

The gas pressure sensor is configured to measure an altitude when the gravity ball falls into the silt.

Preferably, the pore pressure sensors, the gas pressure sensors and the signal collecting and transmitting apparatuses are all symmetrically distributed in the gravity ball, and disposed at a plurality of symmetrical positions in the gravity ball.

Preferably, the pore pressure sensors, the gas pressure sensors and the signal collecting and transmitting apparatuses are all mounted in a threaded connection shell, and the threaded connection shell is provided with external threads. A mounting groove is provided in an inner side of the housing of the gravity ball, and the mounting groove is internally provided with internal threads. The threaded connection shell is inserted into the mounting groove and forms a threaded connection. A wire outlet hole is provided in the bottom of the mounting groove. A wire passes through the wire outlet hole and is electrically connected with components in the threaded connection shell, and the other end of the wire is connected with a power supply and a control element to form a loop.

The wireless detection method implemented using the above wireless detection device for quickly positioning a throw-fill stone falling depth and long-term settlement in blasting silt-squeezing construction, provided by the disclosure, includes the following steps:

1) throwing a gravity ball to a position where blasting silt-squeezing is to be performed before thrown stones are pre-piled or filled, reading parameters in the gravity ball, initializing various detection devices, reading an atmospheric pressure, processing data through a signal receiving, processing and operating system to determine an altitude of the gravity ball, and determining an altitude of throw-fill stones before blasting;

2) performing a blasting operation, monitoring a data change of each monitoring device in real time, and determining a throw-fill stone falling depth through hydrostatic pressure data collected by a vacuum negative pressure test system; and 3) determining a dissipation process of an excess pore pressure caused by blasting through a pore pressure sensor, judging a complete dissipation time, and then determining a final falling depth by collecting hydrostatic pressure data in different degrees of dissipation.

Preferably, a plurality of gravity balls are thrown at different points on the same plane of a blasting point.

Preferably, the method specifically includes the following steps:

1) manufacturing five gravity balls, throwing one gravity ball at a blasting point every two meters along a cross section of a dam before pre-piling throw-fill stones, collecting signals through a land wireless signal receiving system, determining whether each gravity ball is alive or not, initializing, determining an initial altitude of each gravity ball through an atmospheric pressure sensor, and obtaining an average value to acquire an initial altitude when pre-piling the throw-fill stones;

2) performing a blasting operation, enabling the throw-fill stones and the gravity balls to slide into a cavity formed by blasting, the throw-fill stones form stone tongues, monitoring various data of the gravity balls, such as vacuum negative pressure data, in real time, determining a depth change of a sliding process of the gravity balls, and describing a throw-fill stone falling distribution situation according to the depths of the five gravity balls; and 3) reading a pore pressure in real time to determine a dissipation process of the excess pore pressure caused by blasting, reading a vacuum negative pressure according to different time intervals, such as 0, 1, 3, 14, or 28 days, acquiring and calculating a hydrostatic pressure to determine the depths of the gravity balls falling into silt, calculating altitudes of the gravity balls according to the initial altitudes, and collecting data for a long time after complete dissipation to acquire long-term settlement of the throw-fill stones.

The technical effects of the disclosure are as follows:

1) In the disclosure, the throw-fill stone falling depth and distribution situation in the blasting silt-squeezing construction process can be detected in real time by throwing the gravity balls, so that the effect evaluation and quality control of blasting silt-squeezing can be monitored in real time to obtain more accurate detection data, the situation that the falling of throw-fill stones is incomplete can be acquired in time, the construction period and the construction progress can be effectively ensured, and the engineering quality can be improved.

2) The device and the method of the disclosure can be used for measuring physical and mechanical parameters such as consolidation of various underground soil bodies, long-term and short-term settlement, pore pressure, and permeability coefficients in addition to monitoring the blasting silt-squeezing falling depth in real time, and is wider in application range and more accurate in data.

3) The gravity balls in the disclosure can be provided with various devices and instruments for measuring soil body parameters, deformation and the like, so as to carry out multi-directional monitoring to acquire more diversified data, the throw-fill stone failing depth and distribution situation can be monitored in real time, the throw-fill stone falling situation of an entire highway having a roadbed reinforced by blasting silt-squeezing can be monitored in real time, and meanwhile, the long-term settlement and the like of a blasting silt-squeezing roadbed or dam can be monitored.

4) The device and the method of the disclosure are simpler, low in implementation cost, and applicable to more scenarios, the gravity balls can wirelessly transmit signals outwards, the application of the gravity balls can be less influenced by the environment, real-time monitoring is really realized, and a result can be obtained by completing stone throw-fill after blasting.

REFERENCE NUMERALS

Figure 1:
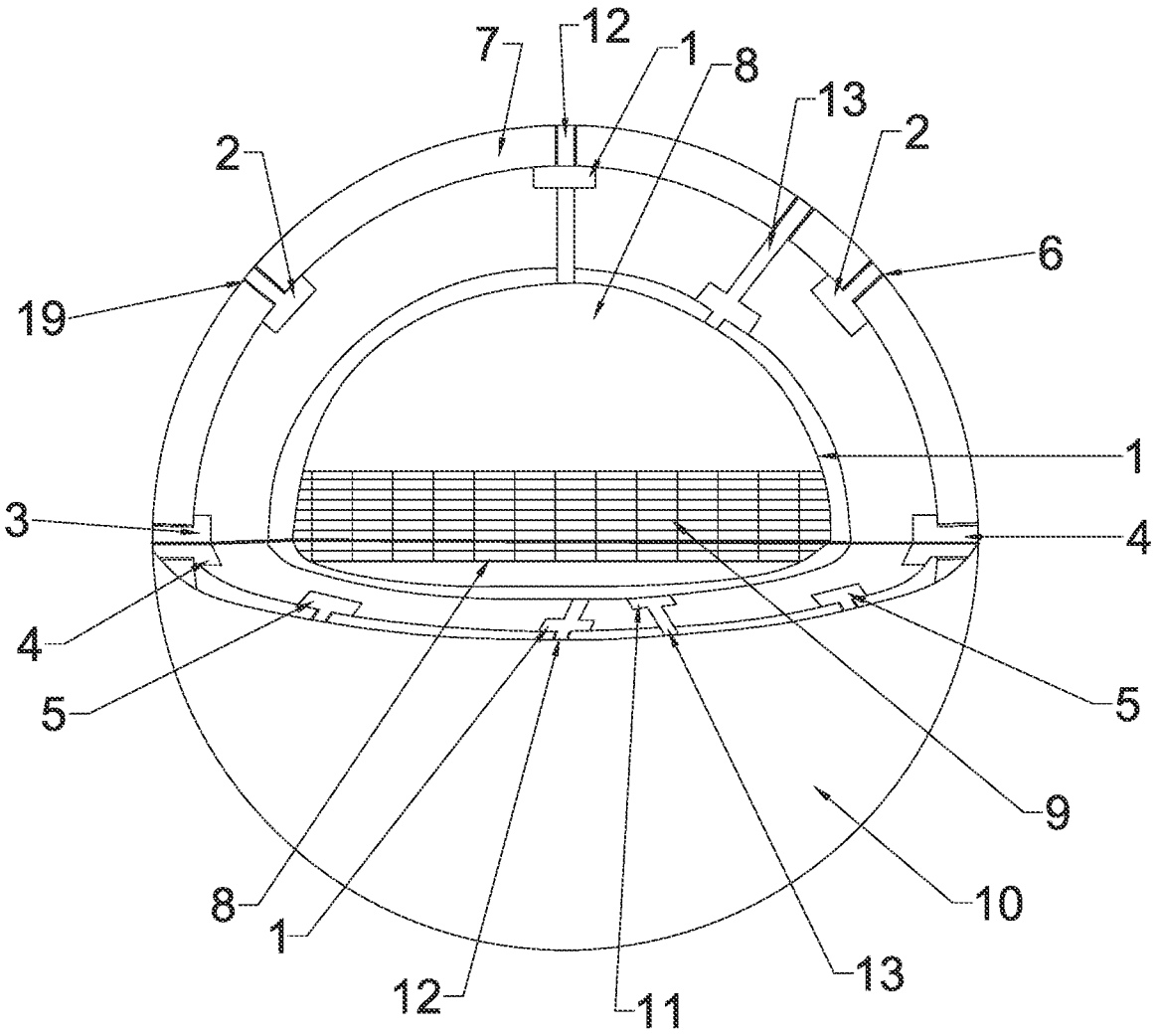
FIG. 1 is a schematic three-dimensional cross-sectional view of a gravity ball provided by the disclosure.

1: Vacuum negative pressure detection apparatus; 2: pore pressure sensor; 3: gas pressure sensor; 4: signal collecting and transmitting apparatus; 5: signal collecting and transmitting apparatus (standby); 6: gas hole; 7: gravity ball outer wall; 8: vacuum negative pressure chamber; 9: battery; 10: gravity ball; 11: vacuum negative pressure gas discharging apparatus; 12: vacuum negative pressure gas hole and fluid channel; 13: vacuum negative pressure gas discharging hole; 14: throw-fill stone contour line before blasting; 15: throw-fill stone contour line after blasting; 16: stone tongue; 17: bearing layer; 18: signal receiving, processing and controlling system; 19: threaded connection shell.

DETAILED DESCRIPTION

The disclosure is further described in detail below in combination with the accompanying drawings and examples. Like parts are designated by like reference numerals. It should be noted that as used in the following description, the terms "front", "rear", "left", "right", "upper", and "lower" refer to directions in the drawings, and the tennis "bottom surface", "top surface", "inner", and "outer" refer to directions toward or away from, respectively, the geometric center of a particular component.

Figure 2:
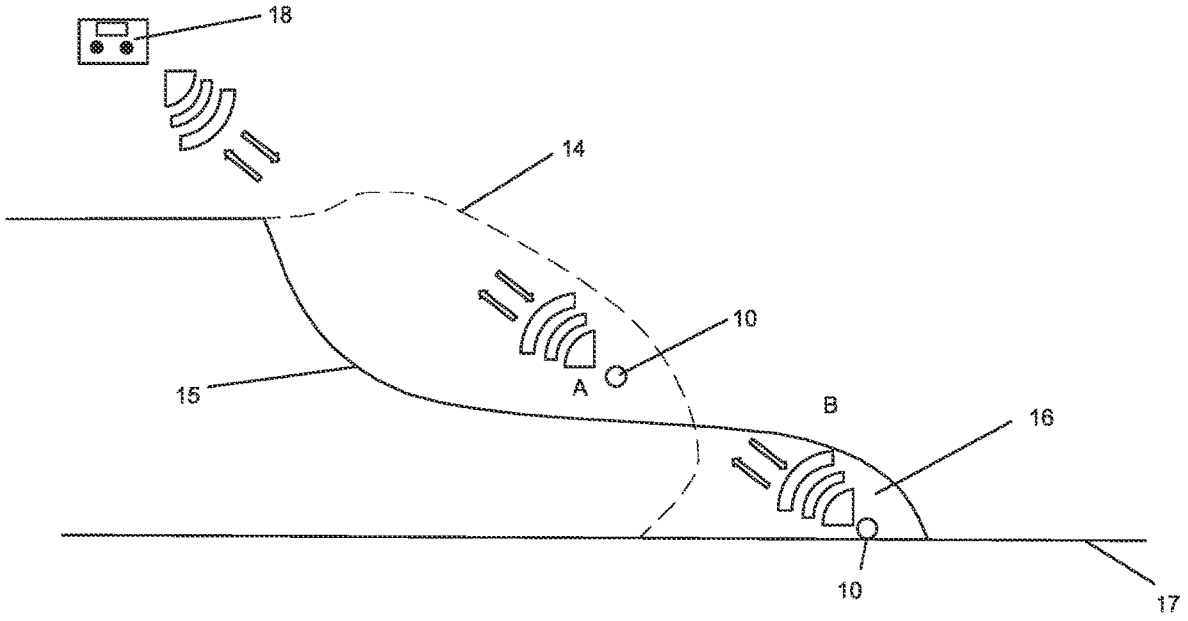
FIG. 2 is a schematic view showing an implementation state of the gravity ball in FIG. 1 for detecting a throw-fill stone falling depth in blasting silt-squeezing.

Referring to FIGS. 1-2, a wireless detection device for quickly positioning a throw-fill stone falling depth and long-term settlement in blasting silt-squeezing construction provided by the disclosure includes a gravity ball 10 and a signal receiving, processing and controlling system. The gravity ball 10 includes a housing 2 supported by corrosion-resistant steel. The housing 2 is internally provided with test mechanisms, signal collecting and transmitting apparatuses 4 and batteries 9. The batteries 9 are arranged in a battery case, occupy the middle part of an inner cavity of the housing 2, and divide the inner cavity of the entire housing 2 into an upper cavity and a lower cavity. The structure is favorable for stable arrangement of the batteries 9 in the housing 2. The test mechanisms send signals obtained by testing outwards through the signal collecting and transmitting apparatuses 4. The signal receiving, processing and controlling system 18 is configured to receive a wireless signal transmitted by the gravity ball 10. The wireless signal is stably connected with a signal receiving system after penetrating through the ground. The signal receiving and controlling system 18 is capable of controlling a monitoring device in the gravity ball. An overall mass-to-volume ratio of the gravity ball is equal or similar to the density of a thrown stone. The signal collecting and transmitting apparatuses 4 collect data collected by the test mechanisms and transmit wireless signals to the land signal receiving, processing and controlling system 18. The batteries 9 provide a continuous source of electrical energy for all monitoring devices.

Referring to FIG. 1, each test mechanism includes a vacuum negative pressure monitoring system, a pore pressure sensor 2 and a gas pressure sensor 3.

The vacuum negative pressure monitoring system includes a vacuum negative pressure detection apparatus 1, a vacuum negative pressure chamber 8, a vacuum negative pressure gas discharging apparatus 11, a vacuum negative pressure gas hole 12 and fluid channel, and a vacuum negative pressure gas discharging hole 13, the vacuum negative pressure detection system is configured to measure a hydrostatic pressure, and gas in the vacuum negative pressure chamber 8 is discharged through the vacuum negative pressure gas discharging apparatus 11, so as to ensure that a vacuum negative pressure state is stable and further ensure that the vacuum negative pressure detection apparatus 1 can normally operate.

The pore pressure sensor 2 is configured to measure a pore pressure in silt to determine a dissipation degree of an excess pore pressure in a blasting operation.

The gas pressure sensor 3 is configured to measure an altitude when the gravity ball 10 falls into the silt.

All the test mechanisms are symmetrically distributed in the gravity ball 10, and disposed at a plurality of symmetrical positions in the gravity ball 10.

The pore pressure sensors 2, the gas pressure sensors 3 and the signal collecting and transmitting apparatuses 1 are all symmetrically distributed in the gravity ball 10, and disposed at a plurality of symmetrical positions in the gravity ball 10. The structure of symmetrical distribution is favorable for acquiring balanced data for mutual comparison. The pore pressure sensors 2, the gas pressure sensors 3 and the signal collecting and transmitting apparatuses 1 are all mounted in a threaded connection shell 19. The threaded connection shell 19 is provided with external threads. A mounting groove is provided in an inner side of the housing of the gravity ball 10. The mounting groove is internally provided with internal threads. The threaded connection shell 19 is inserted into the mounting groove and forms a threaded connection. A wire outlet hole is provided in the bottom of the mounting groove. A wire passes through the wire outlet hole and is electrically connected with components in the threaded connection shell 19, and the other end of the wire is connected with a power supply and a control element to form a loop.

Referring to FIGS. 1-2, a wireless detection method implemented using the above wireless detection device for quickly positioning a throw-fill stone falling depth and long-term settlement in blasting silt-squeezing construction, provided by the disclosure, includes the following steps.

1) A gravity ball is thrown to a position where blasting silt-squeezing is to be performed before thrown stones are pre-piled or filled, parameters in the gravity ball 10 are read, various detection devices are initialized, an atmospheric pressure is read, data is processed through a signal receiving, processing and operating system 18 to determine an altitude of the gravity ball, and an altitude of throw-fill stones before blasting is determined. In order to obtain more accurate data, a plurality of gravity balls 10 are thrown at different points on the same plane at a blasting point.

2) A blasting operation is performed, a data change of each monitoring device is monitored in real time, and a throw-fill stone falling depth is determined through hydrostatic pressure data collected by a vacuum negative pressure test system.

3) A dissipation process of an excess pore pressure caused by blasting is determined through a pore pressure sensor 2, a complete dissipation time is judged, and then a final falling depth is determined by collecting hydrostatic pressure data in different degrees of dissipation.

The method specifically includes the following steps.

1) Five gravity balls 10 are manufactured, one gravity ball 10 is thrown at a blasting point every two meters along a cross section of a dam before pre-piling throw-fill stones, signals are collected through a land wireless signal receiving system, whether each gravity ball 10 is alive or not is determined, initialization is performed, an initial altitude of each gravity ball 10 is determined through an atmospheric pressure sensor 3, and an average value is obtained to acquire an initial altitude when pre-piling the throw-fill stones.

2) A blasting operation is performed, the throw-fill stones and the gravity balls 10 are enabled to slide into a cavity formed by blasting, stone tongues 16 is formed by the throw-fill stones, various data of the gravity balls 10, such as vacuum negative pressure data, are monitored in real time, a depth change of a sliding process of the gravity balls 10 is determined, and a throw-fill stone falling distribution situation is described according to the depths of the five gravity balls 10.

3) A pore pressure is read in real time to determine a dissipation process of the excess pore pressure caused by blasting, a vacuum negative pressure is read according to different time intervals, such as 0, 1, 3, 14, or 28 days, a hydrostatic pressure is acquired and calculated to determine the depths of the gravity balls 10 falling into silt, altitudes of the gravity balls 10 are calculated according to the initial altitudes, and data is collected for a long tune after complete dissipation to acquire long-term settlement of the throw-fill stones.

Referring to FIG. 2, before the blasting operation in the above method, it can be seen by comparing a throw-fill stone contour line 14, a throw-fill stone contour line 15 after blasting, the stone tongue 16 and a bearing layer 17 that the gravity ball falls along with throw-fill stones, and stones are thrown into a cavity formed after blasting.

According to the above wireless detection method implemented by the wireless detection device for quickly positioning a throw-fill stone falling depth and long-term settlement in blasting silt-squeezing construction, a device capable of quickly positioning a throw-fill stone falling depth and distribution and a using method can obtain a result by completing stone throw-fill after blasting, can monitor the throw-fill stone falling depth and distribution situation in real time, can monitor the throw-fill stone falling situation of an entire highway having a roadbed reinforced by blasting silt-squeezing in real time, and can also monitor the long-term settlement and the like of a blasting silt-squeezing roadbed or dam.

The above descriptions are merely preferred implementations of the disclosure, the scope of the disclosure is not limited to the above examples, and all technical solutions falling within the idea of the disclosure fall within the scope of the disclosure. It should be noted that numerous modifications and adaptations may be devised by those of ordinary skill in the art without departing from the principle of the disclosure, and such modifications and adaptations are also considered to be within the scope of the disclosure.

What is claimed is:

1. A wireless detection device for quickly positioning a throw-fill stone falling depth and long-term settlement in blasting silt-squeezing construction, comprising: a gravity ball and a signal receiving, processing and controlling system, wherein the gravity ball comprises a housing supported by corrosion-resistant steel, the housing is internally provided with test mechanisms, signal collecting and transmitting apparatuses and batteries, the test mechanisms send signals obtained by testing outwards through the signal collecting and transmitting apparatuses, the signal receiving, processing and controlling system is configured to receive a wireless signal transmitted by the gravity ball, and the signal receiving and controlling system is capable of controlling a monitoring device in the gravity ball;

wherein each of the test mechanisms comprises a vacuum negative pressure monitoring system, a pore pressure sensor and a gas pressure sensor;

each vacuum negative pressure monitoring system comprises a vacuum negative pressure detection apparatus, a vacuum negative pressure chamber, a vacuum negative pressure gas discharging apparatus, a vacuum negative pressure gas hole and fluid channel, and a vacuum negative pressure gas discharging hole, each vacuum negative pressure detection system is configured to measure a hydrostatic pressure, and gas in each vacuum negative pressure chamber is discharged through a corresponding vacuum negative pressure gas discharging apparatus;

each pore pressure sensor is configured to measure a pore pressure in silt to determine a dissipation degree of an excess pore pressure in a blasting operation; and each gas pressure sensor is configured to measure an altitude when the gravity ball falls into the silt.

2. The wireless detection device for quickly positioning a throw-fill stone falling depth and long-term settlement in blasting silt-squeezing construction according to claim 1, wherein the signal collecting and transmitting apparatuses are symmetrically distributed in the gravity ball, two test mechanisms are provided, and the two test mechanisms are symmetrically distributed in the gravity ball.

* * * * *